US009786218B2

(12) United States Patent
Lee et al.

(10) Patent No.: US 9,786,218 B2
(45) Date of Patent: Oct. 10, 2017

(54) ORGANIC LIGHT EMITTING DISPLAY DEVICE INCLUDING VOLTAGE SUPPLY UNITS

(71) Applicant: Samsung Display Co., Ltd., Yongin, Gyeonggi-do (KR)

(72) Inventors: Seung-Jun Lee, Yongin (KR); Dong-Won Moon, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 52 days.

(21) Appl. No.: 14/525,110

(22) Filed: Oct. 27, 2014

(65) Prior Publication Data

US 2015/0145423 A1 May 28, 2015

(30) Foreign Application Priority Data

Nov. 27, 2013 (KR) ..... 10-2013-0145061

(51) Int. Cl.
*H01L 23/62* (2006.01)
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0426* (2013.01);
(Continued)

(58) Field of Classification Search
CPC ... G09G 2300/0426; G09G 2300/0842; G09G 2300/0866; G09G 2330/02; G09G 2330/025; G09G 2330/028; G09G 2330/04; G09G 2330/08; G09G 2330/12; G09G 3/3225; G09G 3/3233
See application file for complete search history.

(56) References Cited

U.S. PATENT DOCUMENTS 5,900,851 A * 5/1999 Toffolo ..... G09G 3/12 345/36
6,151,016 A * 11/2000 Kanbe ..... G09G 3/3648 345/204
(Continued)

FOREIGN PATENT DOCUMENTS

EP 2 056 282 A2 5/2009
EP 2639784 A2 9/2013
(Continued)

OTHER PUBLICATIONS

European Search Report dated Apr. 22, 2015 for corresponding EP Application No. 14194094.0; 8 Pages.
(Continued)

*Primary Examiner* — Duy T Nguyen
(74) *Attorney, Agent, or Firm* — Lewis Roca Rothgerber Christie LLP

(57) ABSTRACT

An organic light emitting display device includes a pixel unit, a first voltage supply unit, a second voltage supply unit, and a selection unit. The pixel unit includes a plurality of pixels coupled to power lines. The first voltage supply unit is configured to output a first voltage. The second voltage supply unit is configured to output a second voltage. The selection unit is configured to supply any one of the first and second voltages to the pixels through the power lines.

20 Claims, 3 Drawing Sheets

(52) U.S. Cl.
CPC ..... *G09G 2300/0842* (2013.01); *G09G 2300/0866* (2013.01); *G09G 2330/02* (2013.01); *G09G 2330/025* (2013.01); *G09G 2330/028* (2013.01); *G09G 2330/04* (2013.01); *G09G 2330/08* (2013.01); *G09G 2330/12* (2013.01)

(56) References Cited

U.S. PATENT DOCUMENTS

| | | | | |
|---|---|---|---|---|
| 2006/0181327 | A1* | 8/2006 | Lai | G11B 7/00 327/341 |
| 2008/0150846 | A1* | 6/2008 | Chung | G09G 3/3233 345/80 |
| 2008/0158218 | A1* | 7/2008 | Kim | G09G 3/3225 345/212 |
| 2009/0026969 | A1* | 1/2009 | Joo | G09G 3/2022 315/169.3 |
| 2009/0109147 | A1 | 4/2009 | Park et al. | |
| 2010/0091006 | A1 | 4/2010 | Yoo et al. | |
| 2011/0205221 | A1* | 8/2011 | Lin | G09G 3/2092 345/213 |
| 2011/0242087 | A1 | 10/2011 | Ebisuno et al. | |
| 2012/0223684 | A1* | 9/2012 | Lim | G05F 1/563 323/268 |
| 2013/0049708 | A1 | 2/2013 | Nakayama et al. | |
| 2013/0265290 | A1 | 10/2013 | Lee | |

FOREIGN PATENT DOCUMENTS

| | | |
|---|---|---|
| KR | 10-1998-0025493 | 7/1998 |
| KR | 10-1999-0025664 | 4/1999 |
| KR | 10-2005-0095994 | 10/2005 |
| KR | 10-2010-0041085 A | 4/2010 |
| KR | 10-2012-0077574 | 7/2012 |
| KR | 10-2012-0105064 A | 9/2012 |

OTHER PUBLICATIONS

EPO Office Action dated Mar. 22, 2017, for corresponding European Patent Application No. 14194094.0 (7 pages).

* cited by examiner

ORGANIC LIGHT EMITTING DISPLAY DEVICE INCLUDING VOLTAGE SUPPLY UNITS

CROSS-REFERENCE TO RELATED APPLICATION

This application claims priority to and the benefit of Korean Patent Application No. 10-2013-0145061, filed on Nov. 27, 2013, in the Korean Intellectual Property Office, the entire content of which is incorporated herein by reference.

BACKGROUND

1. Field

Aspects of embodiments of the present invention relate to an organic light emitting display device.

2. Description of the Related Art

Recently, there have been developed various kinds of flat panel display devices with reduced weight and volume when compared to cathode ray tubes. Examples of the kinds of flat panel display devices include a liquid crystal display device, a field emission display device, a plasma display panel, an organic light emitting display device, and the like.

Among these flat panel display devices, the organic light emitting display device displays images using organic light emitting diodes that emit light through recombination of electrons and holes. The organic light emitting display has a fast response speed and is driven with low power consumption.

SUMMARY

According to an embodiment of the present invention, an organic light emitting display device includes a pixel unit including a plurality of pixels coupled to (e.g., connected to) power lines, a first voltage supply unit configured to output a first voltage, a second voltage supply unit configured to output a second voltage, and a selection unit configured to supply any one of the first and second voltages to the pixels through the power lines.

The organic light emitting display device may further include a power board, wherein the first voltage supply unit and the selection unit are positioned on the power board.

The organic light emitting display device may further include a voltage controller configured to supply a first compensation signal corresponding to a variation between the first voltage and a first reference voltage to the first voltage supply unit.

The first voltage supply unit may change a voltage level of the first voltage to reflect the first compensation signal.

The voltage controller may supply a second compensation signal corresponding to a variation between the second voltage and a second reference voltage to the second voltage supply unit.

The second voltage supply unit may change the level of the second voltage to reflect the second compensation signal.

The pixel unit may be divided into a first region and a second region. The power lines may include first power lines coupled to (e.g., connected to) the pixels positioned in the first region and second power lines coupled to the pixels positioned in the second region.

The organic light emitting display device may further include first and second boards positioned on a first side (e.g., lower side) of the pixel unit, and third and fourth boards positioned on a second side (e.g., upper side) of the pixel unit, wherein the second side faces oppositely away from the first side.

The second voltage supply unit and the voltage controller may be positioned (e.g., positioned together) on the first board or positioned on the second board.

The first power lines may receive the first or second voltage supplied through the first and third boards. The second power lines may receive the first or second voltage supplied through the second and fourth boards.

The organic light emitting display device may further include a first coupling portion coupled to (e.g., connected to) the first and third boards, and a second coupling portion coupled to the second and fourth boards.

The organic light emitting display device may further include a first cable to couple (e.g., connect) the first coupling portion to the power board, and a second cable to couple the second coupling portion to the power board.

The selection unit may supply the first or second voltage to the first and third boards through the first cable and the first coupling portion, and supply the first or second voltage to the second and fourth boards through the second cable and the second coupling portion.

The selection unit may include a switch unit configured to select and output any one of the first and second voltages respectively supplied from the first and second voltage supply units, and a switching controller to control the switch unit according to a switching control signal.

The organic light emitting display device may further include a timing controller to supply the switching control signal to the switching controller.

The timing controller may be positioned on a control board coupled to (e.g., connected to) at least one of the first and second boards.

The selection unit may supply the first voltage during a first period, and supply the second voltage during a second period.

The first and second periods may be alternately repeated.

The first voltage may have a voltage level different from that of the second voltage.

The second voltage may have a voltage level lower than that of the first voltage.

The pixels may perform an emission operation during the first period and a non-emission operation during the second period.

The first and second voltage supply units may be DC-DC converters.

The first and second coupling portions may be flexible printed circuit boards.

Each pixel may include an organic light emitting diode.

The second reference voltage may have a voltage level lower than that of the first reference voltage.

The voltage controller may supply a first control signal and a second control signal to the first voltage supply unit. The first control signal may control the first voltage supply unit to output a first voltage having a first voltage level and the second control signal may control the first voltage supply unit to output a first voltage having a second voltage level. The voltage controller may measure the level of the first voltage output from the first voltage supply unit according to (e.g., corresponding to) each control signal.

The first voltage supply unit may change the level of the first voltage according to the first and/or second control signal supplied from the voltage controller.

The voltage controller may produce a linear function passing through a first coordinate including the first voltage level and the level of the first voltage measured corresponding to (e.g., according to) the first control signal, and through a second coordinate including the second voltage level and the level of the first voltage measured corresponding to the second control signal.

The voltage controller may produce a setup voltage level corresponding to a set (e.g., predetermined) target voltage level according to the produced linear function, and may set the produced setup voltage level to the first reference voltage.

BRIEF DESCRIPTION OF THE DRAWINGS

Example embodiments of the present invention will be made clear from the below description with reference to the accompanying drawings. However, embodiments of the present invention may be embodied in many different forms and should not be construed as being limited to the embodiments set forth herein. Rather, these embodiments are provided so that this disclosure will be thorough and complete, and will fully convey aspects of the example embodiments to those skilled in the art.

In the drawings, dimensions may be exaggerated for clarity of illustration. It will be understood to those skilled in the art that when an element is referred to as being "between" two elements, it may be the only element between the two elements, or one or more intervening elements may be present. Like reference numerals refer to like elements throughout.

DETAILED DESCRIPTION

Figure 1:
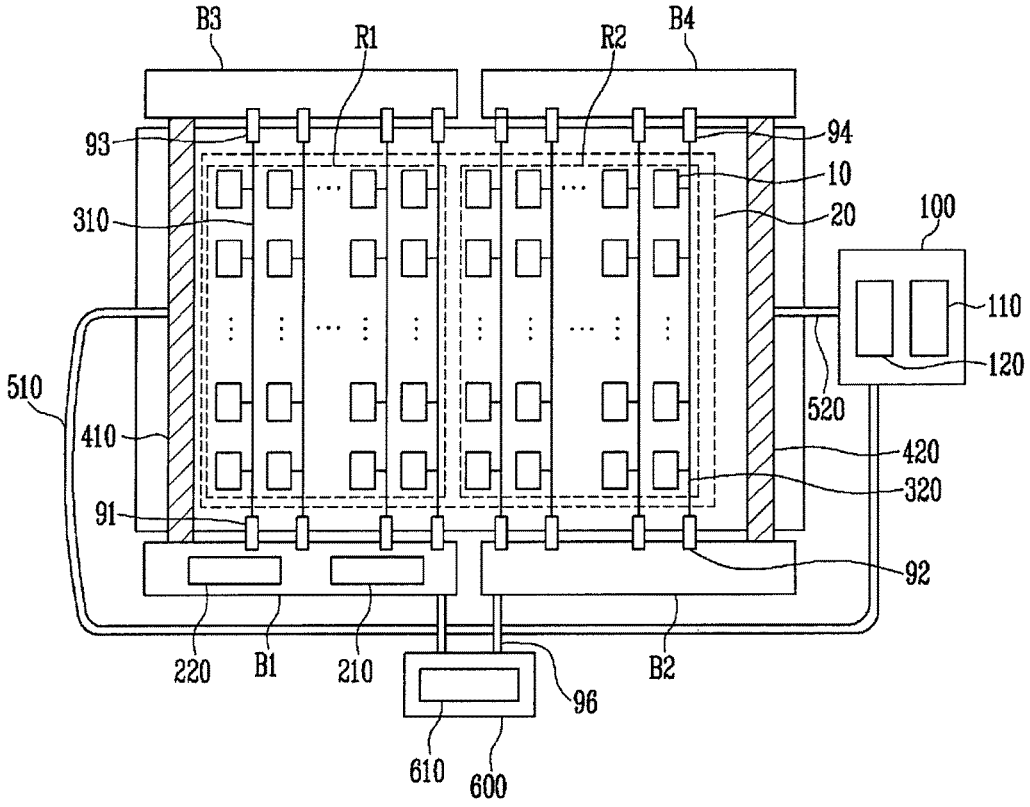
FIG. 1 is a diagram of an organic light emitting display device according to an embodiment of the present invention.

Hereinafter, example embodiments according to the present invention will be described with reference to the accompanying drawings. When a first element is described as being coupled to a second element, the first element may be directly coupled to the second element or may be indirectly coupled to the second element via one or more third elements. In addition, elements and operations that are not related to understanding the scope of the example embodiments of the present invention are omitted for clarity. Like reference numerals refer to like elements throughout the specification.

Figure 2:
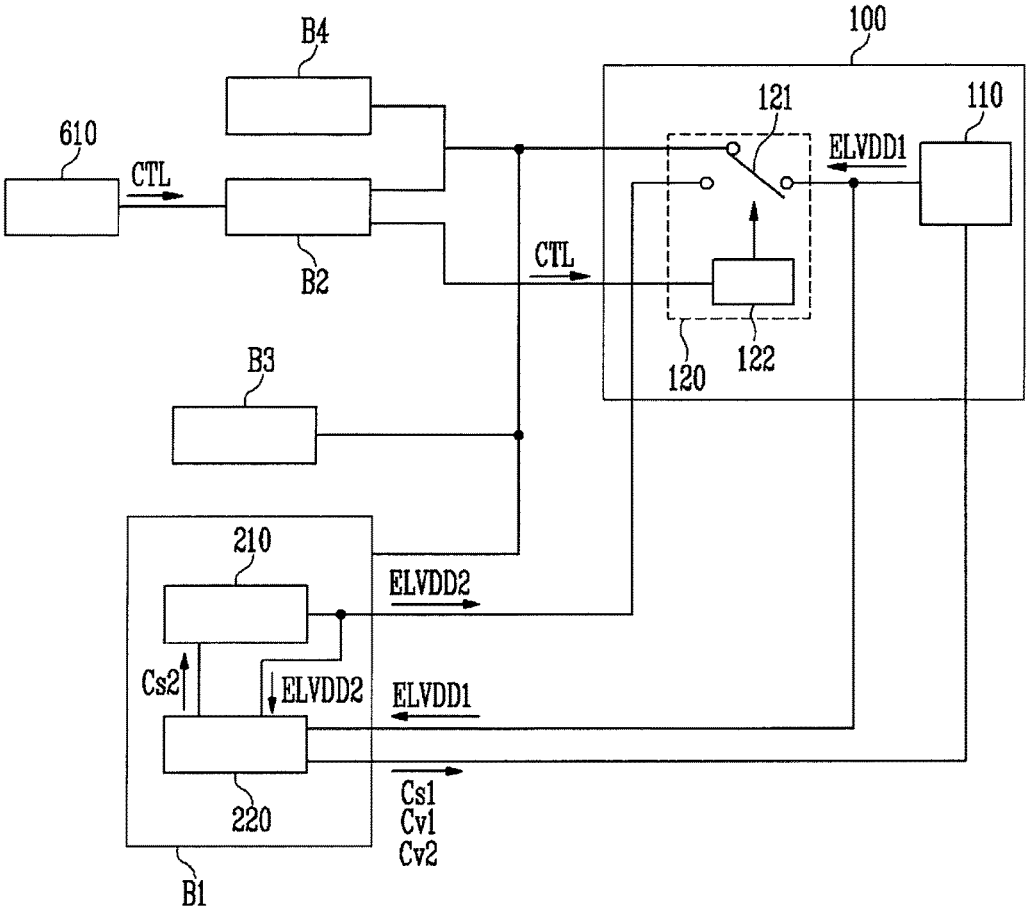
FIG. 2 is a diagram of the coupling relationship between components included in an organic light emitting display device according to an embodiment of the present invention.

FIG. 1 is a diagram of an organic light emitting display device according to an embodiment of the present invention. FIG. 2 is a diagram of the coupling relationship between components included in an organic light emitting display device according to an embodiment of the present invention.

Referring to FIGS. 1 and 2, an organic light emitting display device according to an embodiment of the present invention includes a pixel unit 20 including a plurality of pixels 10, a first voltage supply unit 110, a second voltage supply unit 210 and a selection unit 120.

The pixel unit 20 may include the plurality of pixels 10, thereby displaying a set of predetermined image.

Each pixel 10 may receive a first or second voltage ELVDD1 or ELVDD2 from a respective one of the first and second voltage supply units 110 and 210.

Each pixel 10 may also receive a third voltage ELVSS through a separate voltage supply unit.

For example, each pixel 10 may generate light according to a data signal when current flows from a point at the first voltage ELVDD1 to a point at the third voltage ELVSS via an organic light emitting diode.

The first and second voltages ELVDD1 and ELVDD2 may be set as positive voltages having different voltage levels, and the third voltage ELVSS may be set as a negative voltage.

The second voltage ELVDD2 may have a voltage level lower than that of the first voltage ELVDD1.

The pixels 10 may be coupled to (e.g., connected to) a plurality of power lines 310 and a plurality of power lines 320. For example, as shown in FIG. 1, pixels configured on the same column may be coupled to the same power line.

Each pixel 10 may receive the first or second voltage ELVDD1 or ELVDD2 supplied through the power lines 310 or 320 coupled thereto.

The first voltage supply unit 110 may generate and output the first voltage ELVDD1. The first voltage supply unit 110 may supply the generated first voltage ELVDD1 to the selection unit 120.

The second voltage supply unit 210 may generate and output the second voltage ELVDD2. The second voltage supply unit 210 may supply the generated second voltage ELVDD2 to the selection unit 120.

For example, each of the first and second voltage supply units 110 and 210 may be a DC-DC converter which converts and outputs a voltage that is input from an external source.

The selection unit 120 may supply any one of the first and second voltages ELVDD1 and ELVDD2, respectively output from the first and second voltage supply units 110 and 210, to the pixels 10 through the plurality of power lines 310 and the plurality of power lines 320.

For example, the selection unit 120 may select the first voltage ELVDD1 to supply the first voltage ELVDD1 to the pixels 10, or select the second voltage ELVDD2 to supply the second voltage ELVDD2 to the pixels 10.

In an embodiment, the first voltage supply unit 110 and the selection unit 120 may be positioned on a power board 100.

Thus, the first voltage supply unit 110 can supply the first voltage ELVDD1 to the selection unit 120 positioned on the power board 100, and the second voltage supply unit 210 can supply the second voltage ELVDD2 to the selection unit 120 positioned on the power board 100.

The organic light emitting display device according to an embodiment may further include a voltage controller 220.

The voltage controller 220 may receive the first voltage ELVDD1 supplied (e.g., output) from the first voltage supply unit 110. The voltage controller 220 may compare the first voltage ELVDD1 with a set (e.g., predetermined) first reference voltage Vref1.

The voltage controller 220 may calculate a variation between the first voltage ELVDD1 and the first reference voltage Vref1. The voltage controller 220 may supply the first voltage supply unit 110 with a first compensation signal Cs1 corresponding to (e.g., according to) the calculated variation.

In an embodiment, the first voltage supply unit 110 may supply (or change) the level of the first voltage ELVDD1 to reflect the first compensation signal Cs1 supplied from the voltage controller 220.

Accordingly, although the first voltage supply unit 110 may be replaced (e.g., due to malfunction), the level of the first voltage ELVDD1 supplied (e.g., output) from the replaced first voltage supply unit 110 can be constantly maintained.

The voltage controller 220 may receive the second voltage ELVDD2 supplied (e.g., output) from the second voltage supply unit 210. The voltage controller 220 may compare the second voltage ELVDD2 with a set (e.g., predetermined) second reference voltage Vref2.

The voltage controller 220 may calculate a variation between the second voltage ELVDD2 and the second reference voltage Vref2. The voltage controller 220 may supply the second voltage supply unit 210 with a second compensation signal Cs2 corresponding to (e.g., according to) the calculated variation.

In an embodiment, the second voltage supply unit 210 may supply (or change) the level of the second voltage ELVDD2 to reflect the second compensation signal Cs2 supplied from the voltage controller 220.

Accordingly, although the second voltage supply unit 210 may be replaced (e.g., due to malfunction), the level of the second voltage ELVDD2 supplied (e.g., output) from the replaced second voltage supply unit 210 can be constantly maintained.

In the organic light emitting display device according to an embodiment, the pixel unit 20 may be divided into a first region R1 and a second region R2.

The plurality of power lines 310 and 320 may include a plurality of first power lines 310 coupled to pixels 10 positioned in the first region R1, and a plurality of second power lines 320 coupled to pixels 10 positioned in the second region R2.

The organic light emitting display device according to an embodiment may further include first and second boards B1 and B2, respectively positioned at a lower side of the pixel unit 20, and third and fourth boards B3 and B4, respectively positioned at an upper side of the pixel unit 20.

For example, the first board B1 may be positioned at a lower side of the first region R1, and the second board B2 may be positioned at a lower side of the second region R2.

The third board B3 may be positioned at an upper side of the first region R1, and the fourth board B4 may be positioned at an upper side of the second region R2.

In an embodiment, the second voltage supply unit 210 and the voltage controller 220 may be positioned together on the first board B1, or may be positioned together on the second board B2.

For example, as shown in FIGS. 1 and 2, the second voltage supply unit 210 and the voltage controller 220 are positioned together on the first board B1. However, embodiments of the present invention are not limited thereto, and the second voltage supply unit 210 and the voltage controller 220 may be positioned on any of the first, second, third, or fourth boards B1, B2, B3, and B4, respectively.

The plurality of first power lines 310 may receive the first or second voltage ELVDD1 or ELVDD2 supplied through the first and third boards B1 and B3.

Thus, one end of each of the plurality of first power lines 310 may be coupled to (e.g., connected to) the first board B1 through a respective one of a plurality of first coupling elements 91, and the other end of each of the plurality of first power lines 310 may be coupled to the third board B3 through a respective one of a plurality of third coupling elements 93.

The plurality of second power lines 320 may receive the first or second voltage ELVDD1 or ELVDD2 supplied through the second and fourth boards B2 and B4.

Thus, one end of each of the plurality of second power lines 320 may be coupled to the second board B2 through a respective one of a plurality of second coupling elements 92, and the other end of each of a plurality of second power lines 320 may be coupled to the fourth board B4 through a respective one of a plurality of fourth coupling elements 94.

In an embodiment, the first, second, third and fourth coupling elements 91, 92, 93 and 94 may be implemented with a printed circuit board (PCB), a flexible printed circuit board (FPCB), or the like.

The organic light emitting display device according to an embodiment may further include a first coupling portion 410, a second coupling portion 420, a first cable 510 and a second cable 520.

The first coupling portion 410 may be coupled to (e.g., connected to) the first and third boards B1 and B3. For example, one end of the first coupling portion 410 may be coupled to the first board B1, and the other end of the first coupling portion 410 may be coupled to the third board B3.

The second coupling portion 420 may be coupled to the second and fourth boards B2 and B4. For example, one end of the second coupling portion 420 may be coupled to the second board B2, and the other end of the second coupling portion 420 may be coupled to the fourth board B4.

In an embodiment, the first and second coupling portions 410 and 420 may be implemented with an FPCB.

The first cable 510 may couple (e.g., connect) the first coupling portion 410 to the power board 100. For example, one end of the first cable 510 may be coupled to (e.g., connected to) the first coupling portion 410, and the other end of the first cable 510 may be coupled to the power board 100.

The second cable 520 may couple the second coupling portion 420 to the power board 100. For example, one end of the second cable 520 may be coupled to the second coupling portion 420, and the other end of the second cable 520 may be coupled to the power board 100.

Thus, the selection unit 120 positioned on the power board 100 can supply the first or second voltage ELVDD1 or ELVDD2 to the first and third boards B1 and B3 through the first cable 510 and the first coupling portion 410.

The first or second voltage ELVDD1 or ELVDD2 supplied to the first and third boards B1 and B3 may be supplied to (e.g., provided to) the pixels 10 coupled to (e.g., connected to) the plurality of first power lines 310 through the plurality of coupling elements 91 and 93.

The selection unit 120 positioned on the power board 100 may supply the first or second voltage ELVDD1 or ELVDD2 to the second and fourth boards B2 and B4 through the second cable 520 and the second coupling portion 420.

The first or second voltage ELVDD1 or ELVDD2 supplied to the second and fourth boards B2 and B4 may be supplied to (e.g., provided to) the pixels 10 coupled to (e.g., connected to) the plurality of second power lines 320 through the plurality of coupling elements 92 and 94.

The second voltage supply unit 210 may supply the second voltage ELVDD2 to the selection unit 120 through the first coupling portion 410, the second coupling portion 420, the first cable 510 and the second cable 520.

For example, in an embodiment where the second voltage supply unit 210 is positioned on the first board B1, the second voltage supply unit 210 may supply the second voltage ELVDD2 to the selection unit 120 positioned on the power board 100 through the first coupling portion 410 and the first cable 510.

In an embodiment where the second voltage supply unit 210 is positioned on the second board B2, the second voltage supply unit 210 may supply the second voltage ELVDD2 to the selection unit 120 positioned on the power board 100 through the second coupling portion 420 and the second cable 520.

The voltage controller 220 may receive the first voltage ELVDD1 supplied (e.g., output) from the first voltage supply unit 110 through the first coupling portion 410, the second coupling portion 420, the first cable 510 and the second cable 520.

For example, in an embodiment where the voltage controller 220 is positioned on the first board B1, the voltage controller 220 may receive the first voltage ELVDD1 supplied from the first voltage supply unit 110 positioned on the power board 100 through the first coupling portion 410 and the first cable 510.

In an embodiment where the voltage controller 220 is positioned on the second board B2, the voltage controller 220 may receive the first voltage ELVDD1 supplied from the first voltage supply unit 110 positioned on the power board 100 through the second coupling portion 420 and the second cable 520.

The voltage controller 220 may supply the first compensation signal Cs1 to the first voltage supply unit 110 positioned on the power board 100 through the first coupling portion 410, the second coupling portion 420, the first cable 510 and the second cable 520.

For example, in an embodiment where the voltage controller 220 is positioned on the first board B1, the voltage controller 220 may supply the first compensation signal Cs1 to the first voltage supply unit 110 positioned on the power board 100 through the first coupling portion 410 and the first cable 510.

In an embodiment where the voltage controller 220 is positioned on the second board B2, the voltage controller 220 may supply the first compensation signal Cs1 to the first voltage supply unit 110 positioned on the power board 100 through the second coupling portion 420 and the second cable 520.

Referring to FIG. 2, the selection unit 120 according to an embodiment may include a switch unit 121 and a switching controller 122.

The switch unit 121 may select and output any one of the first and second voltages ELVDD1 and ELVDD2, respectively supplied from the first and second voltage supply units 110 and 210.

For example, the switch unit 121 may be electrically coupled (e.g., electrically connected) to an output terminal of the first voltage supply unit 110 to output the first voltage ELVDD1, or the switch unit 121 may be electrically coupled to an output terminal of the second voltage supply unit 210 to output the second voltage ELVDD2.

The switching controller 122 may control an operation of the switch unit 121, corresponding to (e.g., according to) a switching control signal CTL.

The organic light emitting display device according to an embodiment may further include a timing controller 610 configured to supply the switching control signal CTL to the switching controller 122.

The timing controller 610 may be positioned on a control board 600, and the control board 600 may be coupled to (e.g., connected to) at least one of the first and second boards B1 and B2.

For example, the timing controller 610 may be coupled to at least one of the first and second boards B1 and B2 through a coupling element 96.

In example embodiments, the coupling element 96 may be implemented with a PCB, a FPCB or the like.

Therefore, in an embodiment where the timing controller 610 is coupled to (e.g., connected to) the first board B1, the timing controller 610 may supply the switching control signal CTL to the switching controller 122 positioned on the power board 100 through the first board B1, the first coupling portion 410 and the first cable 510.

In an embodiment where the timing controller 610 is coupled to the second board B2, the timing controller 610 may supply the switching control signal CTL to the switching controller 122 through the second board B2, the second coupling portion 420 and the second cable 520.

Figure 3:
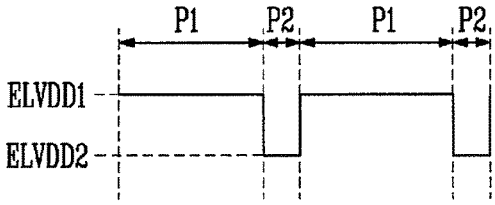
FIG. 3 is a diagram of an operation of an organic light emitting display device according to an embodiment of the present invention.

FIG. 3 is a diagram of an operation of an organic light emitting display device according to an embodiment of the present invention.

Referring to FIG. 3, the organic light emitting display device according to an embodiment may supply the first voltage ELVDD1 to the pixels 10 during a first period P1, and supply the second voltage ELVDD2 to the pixels 10 during a second period P2.

The first and second periods P1 and P2 may be alternately repeated.

The pixels 10 may be configured to emit light (e.g., perform an emission operation) during at least a partial period of the first period P1. The pixels 10 may be configured to perform an initialization or compensation operation while in a non-emission state during at least a partial period of the second period P2.

Figure 4:
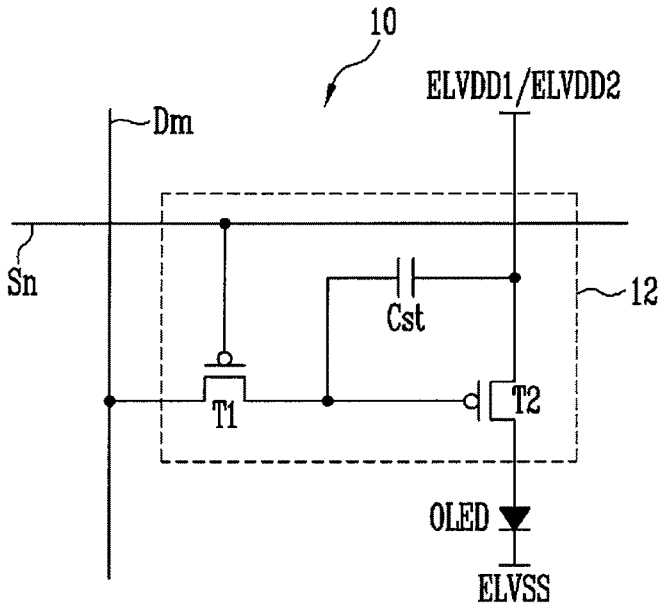
FIG. 4 is a circuit diagram of an example embodiment of a pixel according to an embodiment of FIG. 1.

FIG. 4 is a circuit diagram of an example embodiment of a pixel according to an embodiment of FIG. 1. For convenience of illustration, a pixel 10 coupled to an n-th scan line Sn and an m-th data line Dm is shown in FIG. 4.

Referring to FIG. 4, the pixel 10 includes an organic light emitting diode OLED and a pixel circuit 12 coupled to (e.g., connected to) the data line Dm and to the scan line Sn to control the organic light emitting diode OLED.

An anode electrode of the organic light emitting diode OLED may be coupled to the pixel circuit 12, and a cathode electrode of the organic light emitting diode OLED may be coupled to the third voltage ELVSS.

The organic light emitting diode OLED may generate light with a set (e.g., predetermined) luminance, corresponding to (e.g., according to) current supplied from the pixel circuit 12.

The pixel circuit 12 may control the amount of current supplied to the organic light emitting diode OLED, corresponding to (e.g., according to) a data signal supplied to the data line Dm, when a scan signal is supplied to the scan line Sn. The pixel circuit 12 may include a second transistor T2 coupled (e.g., connected) between the first or second voltage, ELVDD1 or ELVDD2, and the organic light emitting diode OLED. A first transistor T1 may be coupled to the second transistor T2, the data line Dm, and the scan line Sn. A storage capacitor Cst may be coupled between a gate electrode of the second transistor T2 and a first electrode of the second transistor T2.

A gate electrode of the first transistor T1 may be coupled to the scan line Sn, and a first electrode of the first transistor T1 may be coupled to the data line Dm. A second electrode of the first transistor T1 may be coupled to one terminal of the storage capacitor Cst. The first electrode of the first transistor T1 may be any one of a source or a drain electrode, and the second electrode of the first transistor T1 may be the other electrode different from the first electrode. For example, if the first electrode is a source electrode, the second electrode is a drain electrode.

The first transistor T1 coupled to the scan line Sn and the data line Dm may be turned on when a scan signal is supplied to the scan line Sn. When the first transistor T1 is turned on, a data signal may be supplied to the data line Dm and the storage capacitor Cst may charge a voltage corresponding to (e.g., according to) the data signal supplied to the data line Dm.

The gate electrode of the second transistor T2 may be coupled to the one terminal of the storage capacitor Cst, and the first electrode of the second transistor T2 may be coupled to the other terminal of the storage capacitor Cst and the first or second voltage ELVDD1 or ELVDD2. A second electrode of the second transistor T2 may be coupled to the anode electrode of the organic light emitting diode OLED.

The second transistor T2 may control the amount of current flowing from the first voltage ELVDD1 to the third voltage ELVSS via the organic light emitting diode OLED corresponding to (e.g., according to) the voltage stored in the storage capacitor Cst. The organic light emitting diode OLED may generate light corresponding to the amount of current supplied from the second transistor T2.

Each pixel 10 may be controlled to maintain the non-emission state during a period in which the second voltage ELVDD2 is supplied to the respective (e.g., corresponding) pixel 10.

The pixel structure of FIG. 4 described above is an example embodiment of the present invention, but the pixel structure is not limited thereto.

Figure 5:
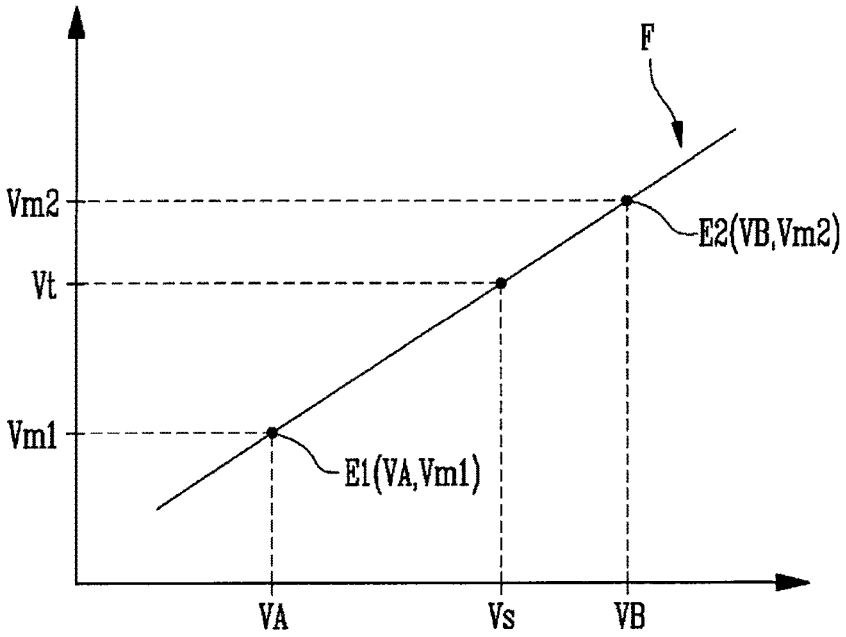
FIG. 5 is a graph illustrating a method in which a voltage controller sets a reference voltage according to an embodiment of the present invention.

FIG. 5 is a graph illustrating a method in which the voltage controller sets a reference voltage according to an embodiment of the present invention.

Referring to FIGS. 2, 4, and 5, the voltage controller 220 of the organic light emitting display device according to an embodiment may supply first and second control signals Cv1 and Cv2 to the first voltage supply unit 110.

The first control signal Cv1 may be a signal to control the first voltage supply unit 110 to output the first voltage ELVDD1 having a first voltage level VA. The second control signal Cv2 may be a signal to control the first voltage supply unit 110 to output the first voltage ELVDD1 having a second voltage level VB.

Accordingly, the first voltage supply unit 110 can supply (or change) the level of the first voltage ELVDD1, corresponding to (e.g., according to) the control signal Cv1 or Cv2 supplied from the voltage controller 220.

The voltage controller 220 may measure the level of the first voltage ELVDD1 output from the first voltage supply unit 110, corresponding to each control signal Cv1 or Cv2.

For example, in an embodiment where the voltage controller 220 supplies the first control signal Cv1 to the first voltage supply unit 110, the first voltage supply unit 110 may supply (or change) the level of the first voltage ELVDD1 to the first voltage level VA, corresponding to the first control signal Cv1.

The voltage controller 220 may measure the level of the first voltage ELVDD1 output from the first voltage supply unit 110.

For convenience, the level of the first voltage ELVDD1 measured corresponding to the first control signal Cv1 will be referred to as a first measurement voltage level Vm1.

Ideally, the first measurement voltage level Vm1 and the first voltage level VA are substantially equal to each other. However, the first measurement voltage level Vm1 and the first voltage level VA may vary due to a self-error of the first voltage supply unit 110, the resistance of other components, and the like.

In an embodiment where the voltage controller 220 supplies the second control signal Cv2 to the first voltage supply unit 110, the first voltage supply unit 110 may supply (or change) the level of the first voltage ELVDD1 to the second voltage level VB, corresponding to the second control signal Cv2.

The voltage controller 220 may measure the level of the first voltage ELVDD1 output from the first voltage supply unit 110.

For convenience, the level of the first voltage ELVDD1 measured corresponding to the second control signal Cv2 will be referred to as a second measurement voltage level Vm2.

Ideally, the second measurement voltage level Vm2 and the second voltage level VB are substantially equal to each other. However, the second measurement voltage level Vm2 and the second voltage level VB may vary due to a self-error of the first voltage supply unit 110, the resistance of other components, and the like.

The voltage controller 220 may produce a linear function F passing through a first coordinate E1 composed of the first voltage level VA and the first measurement voltage level Vm1 and passing through a second coordinate E2 composed of the second voltage level VB and the second measurement voltage level Vm2 by using (e.g., utilizing) the first and second coordinates E1 and E2.

The voltage controller 220 may produce a setup voltage level Vs corresponding to a set (e.g., predetermined) target voltage level Vt, using the produced linear function F. The voltage controller 220 may set the first reference voltage Vref1 according to (e.g., utilizing) the produced setup voltage level Vs.

Accordingly, the voltage controller 220 can correct the first reference voltage Vref1 by reflecting an error which may exist.

The voltage controller 220 may measure the first voltage ELVDD1 output from the first voltage supply unit 110 through the first coupling portion 410, the second coupling portion 420, the first cable 510 and the second cable 520.

For example, in an embodiment where the voltage controller 220 is positioned on the first board B1, the voltage controller 220 is electrically coupled to the output terminal of the first voltage supply unit 110 positioned on the power board 100 through the first coupling portion 410 and the first cable 510. Accordingly, the level of the first voltage ELVDD1 can be measured.

In an embodiment where the voltage controller 220 is positioned on the second board B2, the voltage controller 220 is electrically coupled to the output terminal of the first voltage supply unit 110 positioned on the power board 100 through the second coupling portion 420 and the second cable 520. Accordingly, the level of the first voltage ELVDD1 can be measured.

The voltage controller 220 may supply the control signal Cv1 or Cv2 to the first voltage supply unit 110 positioned on the power board 100 through the first coupling portion 410, the second coupling portion 420, the first cable 510 and the second cable 520.

For example, in an embodiment where the voltage controller 220 is positioned on the first board B1, the voltage controller 220 may supply the control signals Cv1 or Cv2 to the first voltage supply unit 110 positioned on the power board 100 through the first coupling portion 410 and the first cable 510.

In an embodiment where the voltage controller 220 is positioned on the second board B2, the voltage controller 220 may supply the control signals Cv1 or Cv2 to the first voltage supply unit 110 positioned on the power board 100 through the second coupling portion 420 and the second cable 520.

Accordingly, an organic light emitting display device includes a voltage supply unit configured to supply a voltage to pixels.

The voltage supply unit may be replaced due to a defect of the voltage supply unit, etc. However, a variation may exist in the output voltage for the replacement voltage supply unit, and therefore, difficulties in supplying a desired voltage arises when the voltage supply unit is replaced.

As described above, according to the present invention, an organic light emitting display device is provided, which can supply a substantially equivalent voltage when a voltage supply unit is replaced.

Further, an organic light emitting display is provided, which supplies a voltage during the non-emission of pixels through a separate voltage supply unit.

The embodiments described herein have been provided as examples only and should not be construed as limiting the embodiments of the present invention in any way. Accordingly, it will be understood by those skilled in the art that various modifications in form and detail may be made, without departing from the spirit and scope of the present invention as defined in the appended claims, and equivalents thereof.

What is claimed is:

1. An organic glight emitting display device, comprising:

a pixel unit comprising a plurality of pixels coupled to power lines;

a first voltage supply unit configured to output a first voltage;

a second voltage supply unit configured to output a second voltage;

a selection unit configured to supply any one'of the first and second voltages to the pixels through the power fines; and a voltage controller configured to output a compensation signal corresponding to a variation between a reference voltage and the first or second voltage, wherein at least one of the first and second voltage supply units is configured to change a voltage level of the first or second voltage corresponding to the compensation signal supplied thereto, and wherein the voltage controller is configured to set the reference voltage according to a setup voltage level, and to produce the setup voltage level corresponding to a predetermined target voltage level of a linear function passing through a first coordinate corresponding to the first voltage and a second coordinate corresponding to the second voltage.

2. The organic light emitting display device of claim 1, further comprising a power board, wherein the first voltage supply unit and the selection unit are positioned on the power board.

3. The organic light emitting display device of claim 2, wherein the reference voltage includes a first reference voltage, and the voltage controller is configured to supply a first compensation signal corresponding to a variation between the first voltage and the first reference voltage to the first voltage supply unit.

4. The organic light emitting display device of claim 3, wherein the first voltage supply unit is configured to change a voltage level of the first voltage to reflect the first compensation signal.

5. The organic light emitting display device of claim 3, wherein the reference voltage includes a second reference voltage, and the voltage controller is configured to supply a second compensation signal corresponding to a variation between the second voltage and the second reference voltage to the second voltage supply unit.

6. The organic light emitting display device of claim 5, wherein the second voltage supply unit is configured to change a voltage level of the second voltage to reflect the second compensation signal.

7. The organic light emitting display device of claim 3, wherein the pixel unit is divided into a first region and a second region, wherein the power lines comprise first power lines coupled to pixels positioned in the first region and second power lines coupled to pixels positioned in the second region.

8. The organic light emitting display device of claim 7, further comprising:

first and second boards positioned on a first side of the pixel unit; and third and fourth boards positioned on a second side of the pixel unit, wherein the second side faces oppositely away from the first side.

9. The organic light emitting display device of claim 8, wherein the second voltage supply unit and the voltage controller are positioned on the first board or positioned on the second board.

10. The organic light emitting display device of claim 8, wherein the first power lines are configured to receive the first or second voltage supplied through the first and third boards, and wherein the second power lines are configured to receive the first or second voltage supplied through the second and fourth boards.

11. The organic light emitting display device of claim 10, further comprising:

a first coupling portion coupled to the first and third boards; and a second coupling portion coupled to the second and fourth boards.

12. The organic light emitting display device of claim 11, further comprising:

a first cable configured to couple the first coupling portion to the power board; and a second cable configured to couple the second coupling portion to the power board.

13. The organic light emitting display device of claim 12, wherein the selection unit is configured to supply the first or second voltage to the first and third boards through the first cable and the first coupling portion, and to supply the first or second voltage to the second and fourth boards through the second cable and the second coupling portion.

14. The organic light emitting display device of claim 13, wherein the selection unit comprises a switch unit configured to select and output any one of the first and second voltages respectively supplied from the first and second voltage supply units, and a switching controller configured to control the switch unit according to a switching control signal.

15. The organic light emitting display device of claim 14, further comprising a timing controller configured to supply the switching control signal to the switching controller.

16. The organic light emitting display device of claim 11, wherein the first and second coupling portions are flexible printed circuit boards.

17. The organic light emitting display device of claim 15, wherein the timing controller is positioned on a control board coupled to at least one of the first and second boards.

18. The organic light emitting display device of claim 1, wherein the selection unit is configured to supply the first voltage during a first period, and to supply the second voltage during a second period.

19. The organic light emitting display device of claim 18, wherein the first and second periods are alternately repeated.

20. The organic light emitting display device of claim 18, wherein the pixels are configured to perform an emission operation during the first period and a non-emission operation during the second period.

* * * * *